US005367504A

United States Patent [19]

Ferenczy

[11] Patent Number: 5,367,504

[45] Date of Patent: Nov. 22, 1994

[54] TIMEPIECE WITH IMPROVED DISPLAY ADVANCING AND RESETTING MECHANISMS

[75] Inventor: Laszlo Ferenczy, Basel, Switzerland

[73] Assignee: Eta SA Fabriques d' Ebauches, Granges, Switzerland

[21] Appl. No.: 766,563

[22] Filed: Sep. 27, 1991

[30] Foreign Application Priority Data

Oct. 2, 1990 [CH] Switzerland ..... 03171/90-5

[51] Int. Cl.[5] ..... G04B 19/26

[52] U.S. Cl. ..... 368/15; 368/35; 368/37; 368/31; 368/34; 368/190

[58] Field of Search ..... 368/28, 31, 34, 37, 368/35, 185–199

[56] References Cited

U.S. PATENT DOCUMENTS

| | | | |
|---|---|---|---|
| 1,988,782 | 1/1935 | Canepa . | |
| 3,703,805 | 11/1972 | Ganter et al. | 368/34 |
| 4,196,578 | 4/1980 | Besson | 368/188 |
| 4,259,735 | 3/1981 | Vuille | 368/34 |
| 4,674,889 | 6/1987 | Klaus | 368/28 |
| 4,766,579 | 8/1988 | Sporring | 368/190 |
| 4,881,213 | 11/1989 | Zaslawsky | 368/15 |
| 4,974,242 | 11/1990 | Vuilleumier | 368/37 |

FOREIGN PATENT DOCUMENTS

| | | |
|---|---|---|
| 230878 | 8/1987 | European Pat. Off. . |
| 308793 | 3/1989 | European Pat. Off. . |
| 2081855 | 12/1971 | France . |
| 2283477 | 3/1976 | France . |
| 2451443 | 5/1976 | Germany . |
| 671317 | 8/1989 | Switzerland . |

*Primary Examiner*—Bernard Roskoski
*Attorney, Agent, or Firm*—Weil, Gotshal & Manges

[57] ABSTRACT

This invention concerns a timepiece of the mechanical and/or electromechanical type. Such piece comprises a first display mechanism (1), in particular a date display, a second display mechanism (2) such as a moon phase display, rapid correction means (4) for both display mechanisms (1, 2) and a driving organ (6) which controls such display mechanisms (1, 2) and which can absorb equally the displacement of one or the other of these mechanisms, such piece being characterized in that the rapid correction means (4) comprises meshing means (64) common to both mechanisms (1, 2), mounted for rotation and adapted to operate alternatively upon one or the other of such two mechanisms (1, 2) under the action of control means (72, 74). This invention is applicable to calendar and moon phase watches having a center date hand.

12 Claims, 3 Drawing Sheets 1
4
8
9
10
11
12
14
20
21
24
32
34
36
38
40
42
44
60
64
66
68
70
76
78
90
92
94
96
98
100

TIMEPIECE WITH IMPROVED DISPLAY ADVANCING AND RESETTING MECHANISMS

This invention concerns a timepiece of the mechanical and/or electromechanical type, and in particular of the type referred to as a date and moon phase timepiece.

More specifically, this invention concerns timepieces such as wristwatches or horometric movements which are of small dimensions and which include a date display associated with a moon phase display in order to inform the user of the synodic revolution of the moon, referred to as lunar month.

Still more specifically, this invention refers to a timepiece showing dates and moon phases, in which the date wheel which supports the date display and which in a standard manner includes 31 teeth, is arranged at the center of such timepiece coaxial to the hours and minutes pipes.

BACKGROUND OF THE INVENTION

The basic problem in timepieces including date and moon phase displays is to furnish the user rapid correction means of both displays in order to mitigate the consequences either of an interruption in the current supply in the case of an electromechanical timepiece, or failure to operate the winding mechanism for timepieces of the purely mechanical type.

Thus, a first method for changing the date and moon phase display consists in employing the winding stem in the position and function of time setting for the hours and minutes indicating means, then to cause rotation of such indicating means as many times as it is necessary to pass several days, indeed several weeks.

It is well understood that this method is very long since the switching of the mechanisms for displaying respectively the dates and moon phases is repeated only every 24 hours. Thus, such method is very tedious and even laborious.

It is thus necessary to provide the user other means which permit him to correct rapidly both displays without necessarily passing through operation of the hours and minutes indicating means.

Furthermore, it has always been desired that during the normal operation of the movement, passage from one date to another and the visible evolution of the moon phases take place instantaneously. This has given rise to numerous solutions, the most utilized of which are known under the name of jumper mechanisms. Hence, the respective wheels for the dates and moon phases are constituted by star wheels, that is to say, by discs having triangular teeth the driving of which must be effected by a device which is not in constant mesh with such stars but which, over a predetermined period, namely every 24 hours, effects successive or simultaneous operation of such two stars.

This driving d&vice may be constituted for instance by a pin which is fixed to a wheel and which meshes with a setting wheel of the horometric movement.

However, it is understood that when such jumper mechanism is combined with a rapid correction system, one of the pins or the driving pin of the stars may be in mesh, for instance with the date star, while at the same moment the user modifies the displayed date.

The time lapse during which the pin is in mesh with a corresponding star is relatively long so that this probability is far from being negligible.

Timepieces generally cannot withstand a reversible operation of the stars and there would occur in such case blockage or breakage of one of the constituents.

Swiss patent CH Nr. 4542 dating from 1891 proposes an improved date mechanism which addresses this problem.

Such mechanism includes in a standard manner a date star for displaying dates as well as a lunar month star for displaying moon phases. These two stars are driven in a successive manner by a unique driving device which is connected to a setting wheel of the horometric movement and which is equipped on its face with a lifting piece subjected to the action of a spring. Such lifting piece comes into mesh sometimes with the date star, sometimes with the moon phase star in order to bring about their advance in combination with jumper springs.

Furthermore, such date mechanism includes corrector devices, namely elongated levers pivotally mounted on the base plate of the movement, a first free end of which is brought to operate one of the corresponding stars, while a second end is arranged outside the watch case. Thus, the user, in pressing these corrector devices, operates directly on the date and lunar month stars and he may thus change the display in a corresponding manner. Furthermore, since the lifting piece of the driving device is elastically coupled to the wheel which bears it, such lifting piece through a click phenomenon, withstands the operation of these return devices without passing the effect back to the wheel, thus to the other constituents of the movement.

Nevertheless, such a mechanism includes numerous disadvantages.

Effectively, the use of correctors initially requires lateral openings in the case which is thus difficult to render moisture-tight also not forgetting that such correctors are generally not particularly aesthetic.

Furthermore, such correctors are of a complex form and being relatively long, necessitate for their displacement considerable travel and thus considerable space. Additionally, their manufacture and assembly increase substantially the cost price of the timepieces.

It will also be noted that in this patent, the two stars respectively for the date and moon phases are greatly separated from one another so that they also occupy considerable space. It is thus understood that such an arrangement is initially costly, but also that it may not be applied to fabrication of a timepiece of small dimensions which above all should be compact.

Additionally, such mechanism may only with difficulty equip a timepiece in which the date star is centered on the movement since in such a case the moon phase star must be placed still more towards the exterior of the movement, being given that the respective axes of the date star, the moon phase star and the driving device are arranged on a straight line.

Furthermore, there is described in the work "Les montres calendriers modernes" of B. Humbert, published in 1953 in the editions of the "Journal Suisse d'Horlogerie" pages 100 and 101, FIG. 159, a mechanism in which the date star with 31 teeth is centered on the horometric movement in a manner coaxial to the hours and minutes indicators. The day star bears a hand which advances in coincidence with the days of the week indication marked on the outer periphery of the dial.

In this caliber, the space requirement has been substantially optimized by the use of a single driving device, as in the preceding mechanism, but having a conception completely special. Effectively, such driving device includes a cam freely mounted on a wheel which is driven by the horometric movement. On such cam are arranged fingers, one being intended to drive successively the date star and the other, that of the moon phases.

Such cam is driven by the wheel to which it is fixed through a pin housed in a partial clearance arranged on the periphery of the cam. In such clearance are formed two shoulders adapted to butt against the pin.

Thus, when one wishes rapid correction of one of the display stars, the cam may separate from the pin which pushes it since such cam is freely mounted relative to the driving wheel.

Nevertheless, this conception is relatively complex since it necessitates difficult machining operations and costly assembly and adjustment operations of the elements among themselves.

Thus, here again it is understood that it is impossible with this calibre to offer very small dimensions at the lowest possible price.

Thus, the present invention has as purpose to overcome these difficulties in proposing a timepiece of the mechanical and/or electromechanical type and particularly a timepiece furnishing displays, in particular of dates and moon phases which are of small dimensions, obtainable at very low cost and which includes rapid correction means for such displays which are simple and do not change the compactness of the assembly.

SUMMARY OF THE INVENTION

In accordance with the invention, there is provided a mechanical or electromechanical timepiece which includes first and second display mechanisms for displaying, for instance, the date and phases of the moon, respectively, each of which is changed in a substantially instantaneous manner at a fixed frequency. A rapid correction mechanism is provided for resetting both the first and second display mechanism that is preferably accessible from the exterior of the timepiece. A driving device is kinematically coupled to a setting wheel and makes one complete rotation during such pre-determined time period for controlling both the first and the second display mechanisms. The driving device includes means for absorbing displacement of the display mechanism with which it is in mesh when such display mechanism is simultaneously operated upon by the rapid correction mechanism. The rapid correction mechanism acts alternately on one or the other of the two display mechanisms during the resetting operation under the control of the control mechanism.

It is understood thus that with this arrangement, namely the combination of a unique driving device and a rapid correction system common to both mechanisms, one may provide a rational arrangement in which the rapid correction system may be arranged substantially facing the driving device, this occupying a minimum amount of space and enabling simple and inexpensive manufacture.

But other characteristics and advantages of the invention will appear upon reading the detailed description which follows, prepared with reference to the annexed drawings which are given solely by way of example.

DESCRIPTION OF THE PREFERRED EMBODIMENT

Figure 1:
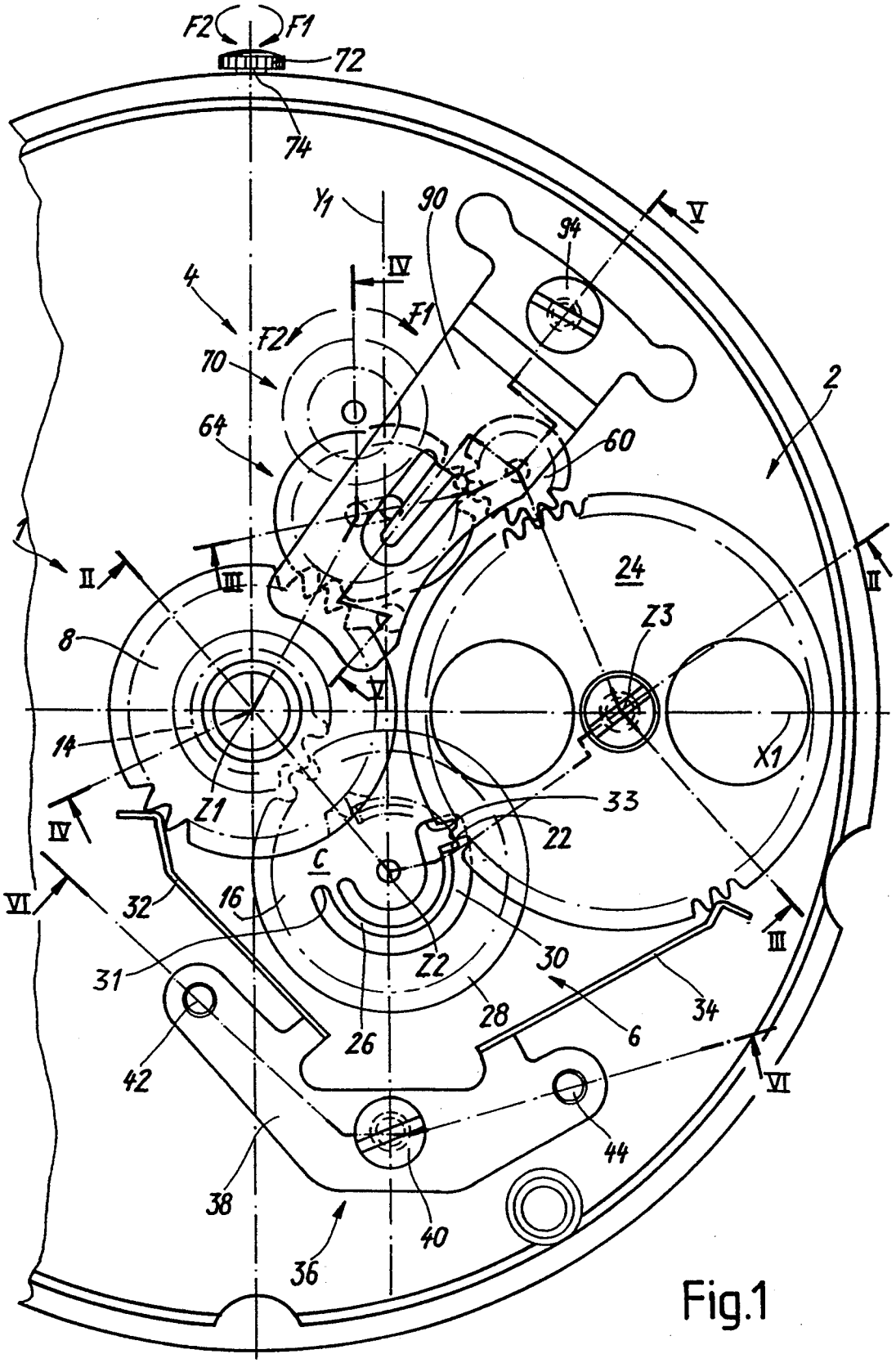
FIG. 1 is a top view of a timepiece in which are shown only the essential elements of the invention.

Referring to FIG. 1, there is seen a timepiece according to the invention which includes a first display mechanism 1, in particular a date display as well as a second display mechanism 2 such as a moon phase display.

Additionally, such timepiece includes, on one hand rapid correction means 4 for both display mechanisms respectively 1 and 2, and on the other hand a driving device 6 which is formed in order to bring about successively the displacements of these mechanisms.

Figure 2:
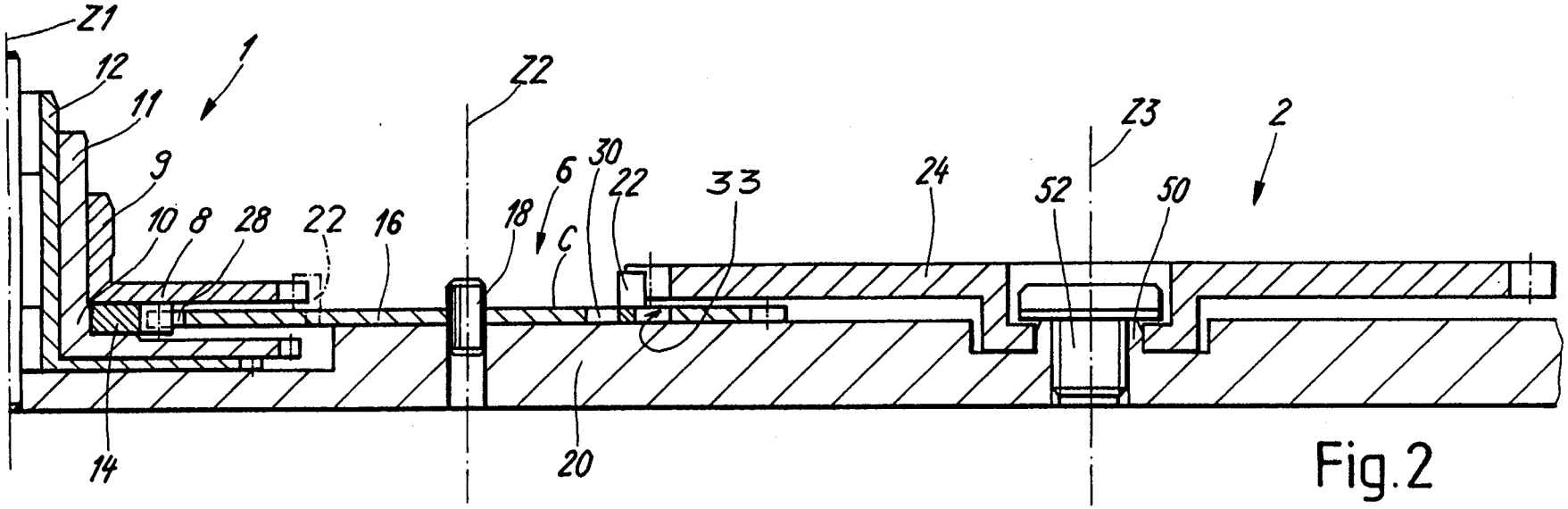
FIG. 2 is a cross-section taken along line II—II of FIG. I.

As is seen in particular on FIG. 2, the date display mechanism 1 includes a date wheel 8 of the cannon wheel type, the pipe 9 of which is freely mounted in rotation on a central pipe 11 of an hours wheel 10. The central hours pipe 11 itself is assembled in a coaxial manner on a minutes pipe 12, such assembly being adapted to pivot about a rotational axis Z1. As is well understood, pipe 9 for the date wheel 8 as well as pipes 11 and 12 respectively for hours and minutes are intended to receive indicating hands generally moving above a dial on which are inscribed appropriate indications (not shown). The date wheel 8 is arranged in free axial support on a setting wheel 14 driven onto the hours cannon wheel 10. Thus, setting wheel 14 is directly arranged below the date wheel 8 and is held in sandwich between this latter and the hours cannon wheel 10.

The driving device 6 includes a wheel 16 the exterior peripheral teeth 28 of which mesh permanently with the setting wheel 14.

The setting wheel 14 includes 12 teeth and effects one revolution in twelve hours, while the wheel 16 of the driving device 6 includes 24 teeth and rotates in 24 hours.

Wheel 16 is freely mounted in rotation around a geometric axis Z2 on a pivot 18 driven into a base plate 20. Such wheel 16 is furthermore axially supported by its back face on base plate 20. A single driving finger 22 is arranged on such wheel 16, which is shaped in order to mesh successively with the two display mechanisms 1 and 2 and more particularly, on the one hand, with the date wheel 8 of the first mechanism 1 as well as, on the other hand, with a moon phase wheel 24 of the second mechanism 2.

The driving finger 22 is integral with an elastic arm 26 and is preferably formed from the material thereof. Elastic arm 26 is directly arranged on the body or plate C of wheel 16 and thus preferably it is also formed from the same material as such wheel 16.

Thus, it will be noted that the body or plate C on wheel 16 is partially cut away around pivot 18 between this latter and the outer peripheral teeth 28 of wheel 16.

The opening, or cavity thus obtained, referenced 30, extends in a manner partially inwardly curved and centered on the rotational axis Z2 of wheel 16. The elastic arm 26 is essentially housed within this opening 30. The base of the elastic arm 26 extends and projects from one end edge 31 of opening 30 in the direction towards the other end edge 33 of such opening in a manner coplanar with wheel 16 and following an arc centered on the rotation axis Z2. It will thus be noted that arm 26 is arranged essentially within the thickness of wheel ]6. From this fact, since arm 26 is substantially arranged in the same plane as the body or plate C of wheel 16 and consequently in the same plane as teeth 28, arm 26 which is essentially indrawn may be displaced at any instant and in all directions within the interior of the opening or cavity 30. The drive finger 22, which is arranged at the free end of elastic arm 26 in the extension of the latter, projects in a manner substantially normal to the wheel 16 and to arm 26 in order to come into successive engagement with the moon phase wheel 24, then with the date wheel 8 and inversely.

Arm 26 and drive finger 22 which are arranged between teeth 28 of wheel 16 and its rotation axis Z2 are advantageously obtained by stamping in body C of wheel 16 by operations together with the operations for providing the teeth 28.

Wheel 16, being mechanically driven by the setting wheel 14, may bring about the displacement of the two wheels respectively moon phase 24 and date 8, at a frequency fixed on a predetermined time period, namely every 24 hours, and this via drive finger 22 which comes into mesh with the outer teeth of these wheels. Since the drive finger 22 is elastically coupled to the wheel 16 which bears it through arm 26, it is understood that it is possible to act exteriorly on both display mechanisms 1 and 2, in particular through correction means 4, without there being any consequence, that is to say, a reversing action on the other elements of the timepiece, for instance on setting wheel 14. Effectively, elastic arm 26 absorbs equally the displacement of one or the other of the display mechanisms 1 or 2 when the driving device 6 and in particular the drive finger 22 of wheel 16 is in mesh with one of these two mechanisms 1 or 2 and the mechanism with which such drive device 6 meshes simultaneously undergoes operation of the correction means 4.

Elastic arm 26, when it meshes with wheel 8, has the possibility of extending partially under the teeth of wheel 24. One may thus produce a relatively long elastic arm 26 arranged proximate the outer teeth 28.

On the other hand, it is noted that the drive finger 22 thanks to its radial movement freedom, in addition to its tangential freedom of movement, may go right to the bottom of the teeth of one of wheels 8 or 24 without jamming during meshing between drive device 6 and wheels 8 and 24.

One may thus provide less severe manufacturing tolerances.

Furthermore, the axial play of wheel 16 is limited by the two wheels 8 and 24 under which such wheel moves.

In order to be able to pivot in an instantaneous manner, that is to say by jumps, both the date wheel 8 and the moon phase wheel 24 are respectively associated with elastic extensions 32 and 34. One of the faces, referred to as the interior face, of the free elbowed ends of such extensions comes to act as a click on the outer teeth of the two wheels 8 and 24.

It will be noted that the two elastic extensions 32 and 34 are of the same material and are arranged on the same unique jumper spring 36 common to the two display mechanisms 1 and 2. The jumper spring 36 thus includes a base 38 in the central region of which is placed a fastening screw 40 engaged in base plate 20. Two positioning studs 42 and 44 are engaged in corresponding orifices arranged in the end regions or wings of base 38 in order to permit the relative positioning of the elastic extensions 32 and 34 relative to wheels 8 and 24 with which they cooperate prior to definitive fastening by screw 40. It will furthermore be noted that both extensions 32 and 34 which project normally from base 38 extend relative to one another in the form of a V within which the driving device 6 may be advantageously located.

The moon phase wheel 24 is pivotally mounted on a collet 50 arranged in base plate 20 and in which is engaged a fastening screw 52 the head of which axially maintains wheel 24, mounted to be free in rotation relative to base plate 20 around a rotation axis Z3.

Figure 3:
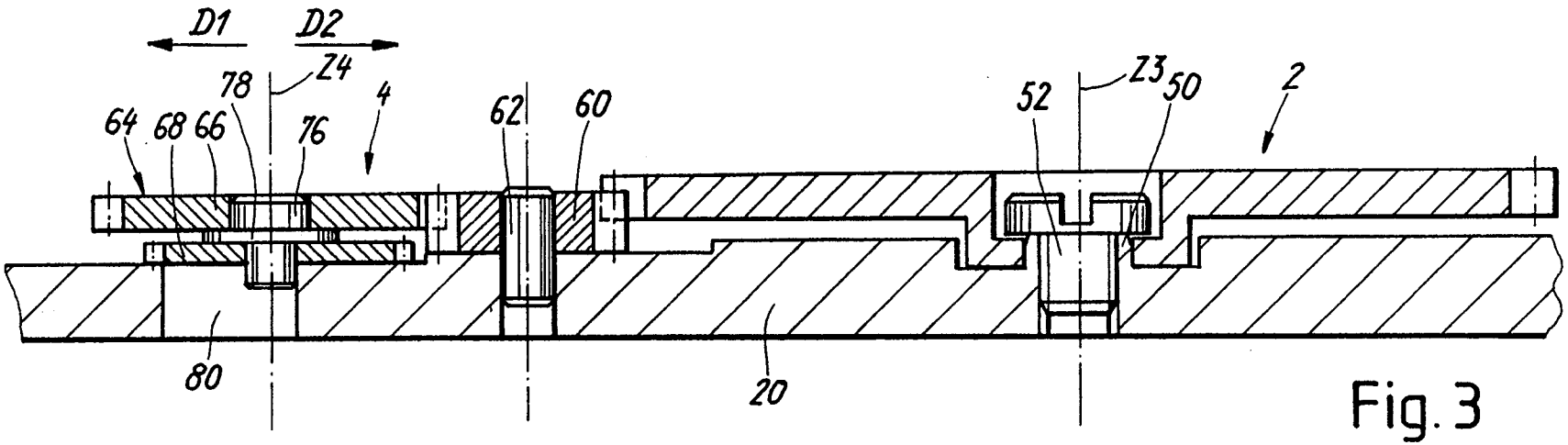
FIG. 3 is a cross-sectional view taken along line III—III of FIG. 1, essentially representing the arrangement of wheel sets forming respectively a moon phase display mechanism and rapid correction means.

Referring particularly to FIG. 3, there will be noted that the moon phase wheel 24 may be operated by correction means 4, preferably with the aid of an intermediate pinion 60 in constant mesh with the moon phase wheel 24. Such intermediate pinion 60 is mounted to rotate freely on a pivot 62 driven into base plate 20 and it enables rotating both wheels 8 and 24 in the same sense.

Figures 4, 5, 6:
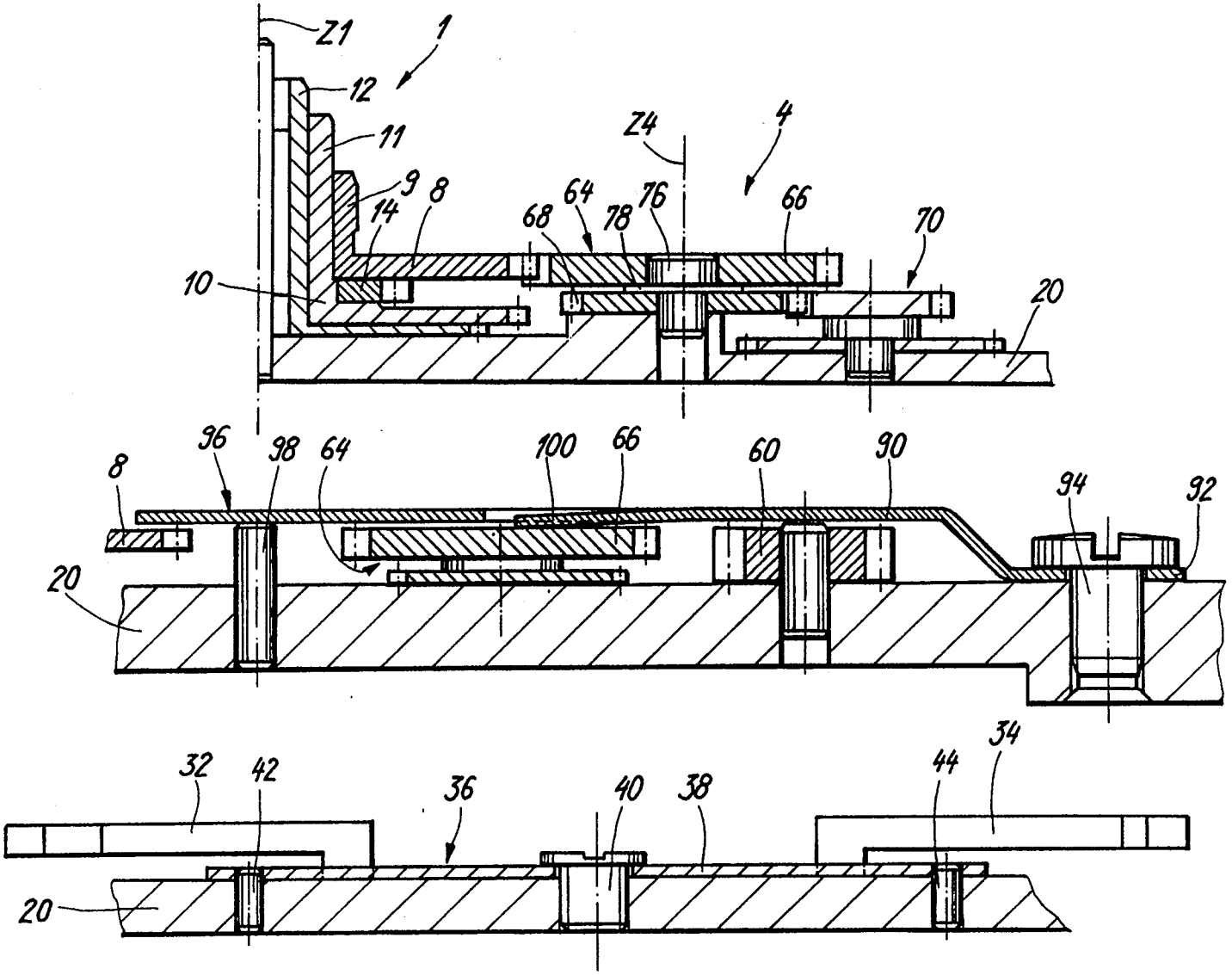
FIG. 4 is a cross-section taken along line IV—IV of FIG. 1 and more specifically representing different wheel sets forming in particular a display mechanism and rapid correction means of FIG. 3.
FIG. 5 is a cross-section taken along line V—V of FIG. 1.
FIG. 6 is a cross-sectional view of a jumper spring taken along line VI–VI of FIG. 1.

As may furthermore be seen on FIGS. 3 and 4, the rapid correction means 4 of both display mechanisms 1 and 2 includes a pinion 64 of the shifting type. Such shifting pinion 64 is a stepped pinion, a first step of which, referred to as upper, is constituted by a wheel 66 adapted to be brought into mesh either with the date wheel 8 (FIG. 4) or indirectly, that is to say through a pinion 60, with the moon phase wheel 24 (FIG. 3). In another embodiment (not shown), no intermediate pinion 60 is provided so that wheel 66 may be brought to mesh directly with the moon phase wheel 24.

The second or lower step of the shifting pinion 64 is constituted by a pinion 68 which meshes permanently with a correction wheel 70 (FIG. 4) coupled kinematically, preferably by mechanical means not shown, to unique control means constituted by a crown 72—winding stem 74 assembly shown on FIG. 1. The coupling between the correction wheels 70 and the exterior control means 72, 74 being standard, it has not here been shown in a detailed manner.

The shifting pinion 64 further includes a stepped pivot 76, the upper portion of which receives wheel 66 driven thereon, while driven on to the lower portion of such pivot 66 is pinion 68 which is mechanically operated by correction wheel 70. Wheel 66 and pinion 68 are axially separated through a collet 78 directly arranged on pivot 76.

The lower portion of pivot 76 is mounted to be free in rotation and translation within a guide slot 80 in order to permit the shifting pinion 64 to be freely displaced in translation relative to base plate 20. Slot 80 straight or substantially curved. Thus, when correction wheel 70 is caused to turn by the outer control means 72, 74 in a first direction represented by arrow F1 (FIG. 1), the shifting pinion 64 is displaced in slot 80 according to a first sense of displacement D1 (FIG. 3) so as to go towards the date wheel 8 and to be brought into mesh with the latter. One may thus correct the displayed date in an extremely rapid manner.

When one turns the correction wheel 70 in the sense of arrow F2, as previously through the exterior control means 72, 74, the shifting pinion 64 henceforth is translated towards the intermediate pinion 60 in a second displacement sense D2 to come into mesh with such pinion 60. One may thus rapidly modify the information furnished the second moon phase display mechanism 2.

It is understood thus that the shifting pinion 64 constitutes the meshing means common to both display mechanisms 1 and 2 mounted for rotation and adapted to act alternately under the action of a control means 72, 74 on one or on the other of such two mechanisms 1 and 2.

It will be noted that the rotation axis Z4 of pinion 64 is displaceable in translation relative to base plate 20.

The timepiece according to the invention further includes a support clamp 90 (FIGS. 1 and 5) the seat 92 of which is maintained fixedly on base plate 20 through a fastening screw 94 engaged in the base plate. The seat 92 is arranged in the neighbourhood of the periphery of the timepiece according to the invention. From such seat 92 extends a covering portion 96 which is brought to cap at least partially the intermediate pinion 60 the shifting pinion 64 as well as the date wheel 8. This covering portion 96, at its free end rests on a pin 98 driven into base plate 20 and permitting the definition of a fixed height between such covering portion 96 and the upper surface of the base plate 20. Within this covering portion 96 is arranged a tongue 100 which is cut out by stamping and which is slightly curved towards base plate 20 so as to be brought to bear on the upper surface of the shifting pinion 64 and in particular on its wheel 66. This loading facilitates the displacement in translation of the shifting pinion 64 through creation of a pressure bringing about a resistance moment during the operation of the correction wheel 70.

The rotation axis Z1 of the date wheel 8 is in common with the central axis of the timepiece in accordance with the invention.

Thus, the two rotation axes respectively Z1 of the date wheel 8 and Z3 of the moon phase wheel 24 may be joined by a normal geometric axis X1 constituting one of the radii of the timepiece according to the invention.

It will be observed that the rapid correction means 4 and the driving device 6 are arranged on either side of the geometric axis X1 joining the two rotation axes Z1 and Z3. Thus, the meshing means 64 are arranged in a manner substantially opposite the driving device 6 and substantially perpendicular to the latter relative to the geometric axis X1.

Since the drive device 6 and the rapid correction means 4 are arranged facing one another on either side of the two display mechanisms 1 and 2, there is obtained a particularly compact construction occupying a minimum of space.

In other words, there is obtained a construction referred to as the cross form in which the two respective axes of rotation Z4 of the shifting pinion 64 and Z2 of the drive device 6 form a geometric axis Y1 (FIG. 1) substantially normal to the geometric axis X1.

Extensions 32 and 34 are arranged on either side of the geometric axis Y1, the common unique jumper spring 36 being substantially centered relative to such geometric axis Y1.

It will also be observed that in this construction the days wheel 8 and the moon phase wheel 24 are extremely close together, which diminishes by as much their overall dimensions.

What I claim is:

1. A timepiece of the mechanical or electromechanical type comprising:

first and second display mechanisms spaced from one another along geometrical axis, each for displaying time varying information;

rapid correction means operable for correcting both display mechanisms, including control means accessible from the exterior of the timepiece, and means for alternatively engaging said first and second display mechanisms under the action of the control means; and a driving device including second means for engaging said first and second display mechanisms for periodically advancing said first and second display mechanisms by predetermined increments, the time periods between such advances being the same for said first and second display mechanisms, said driving device further including resilient means for absorbing the displacement of one of said display mechanisms when said rapid correction means operates on said one display mechanism while said driving device is engaged therewith, said alternative engaging means being positioned substantially opposite the driving device relative to said geometrical axis.

2. A timepiece as set forth in claim 1 wherein said control means comprises a crown-winding stem assembly.

3. A timepiece as set forth in claim 1 wherein the alternative engaging means of said rapid correction means include a pinion of the shifting type.

4. A timepiece as set forth in claim 1 further including a setting gear and wherein the engaging means of said driving device includes a rotatable gear wheel mounted in permanent mesh with said setting gear and a drive finger elastically coupled to said gear wheel, and said finger being positioned on said gear wheel to come into mesh successively with the first and second display mechanisms during the rotation of said gear wheel by said setting gear.

5. A timepiece as set forth in claim 4 wherein said gear wheel includes an elastic arm arranged in the body thereof, said finger being integral with said elastic arm.

6. A timepiece as set forth in claim 5 wherein said finger and the arm with which it is integral are formed of material from the gear wheel.

7. A timepiece as set forth in claim 5 wherein the elastic arm is arranged in the same plane as that of the teeth of the gear wheel.

8. A timepiece as set forth in claim 5 wherein said arm is curved and exhibits a radius of curvature centered on the rotation of said gear wheel.

9. A timepiece as set forth in claim 5 wherein arm has an end attached to said wheel and a free end and said finger is arranged at said free end of the arm and projects substantially normal thereto.

10. A timepiece as set forth in claim 5 wherein the arm and the finger are formed by stamping in the body of the wheel.

11. A timepiece as set forth in claim 1 further including a jumper spring common to both display mechanisms and which includes two extensions in a V arrangement forming springs acting respectively on one of the two mechanisms.

12. A timepiece as set forth in claim 1 wherein said control means comprises a crown-winding stem assembly.

* * * * *